US007477119B2

(12) United States Patent
Wu

(10) Patent No.: US 7,477,119 B2
(45) Date of Patent: Jan. 13, 2009

(54) ELECTROMAGNETIC RELAY

(75) Inventor: Te-Kang Wu, Taichung (TW)

(73) Assignee: Good Sky Electric Co., Ltd., Taichung (TW)

( * ) Notice: Subject to any disclaimer, the term of this patent is extended or adjusted under 35 U.S.C. 154(b) by 178 days.

(21) Appl. No.: 11/713,510

(22) Filed: Mar. 2, 2007

(65) Prior Publication Data

US 2008/0211608 A1 Sep. 4, 2008

(51) Int. Cl.
*H01H 51/22* (2006.01)
*H01H 67/02* (2006.01)

(52) U.S. Cl. ..... 335/83; 335/128; 335/129

(58) Field of Classification Search ..... 335/78, 335/80, 83; 200/8 A, 11 A, 16 A, 243, 447
See application file for complete search history.

(56) References Cited

U.S. PATENT DOCUMENTS 2,068,093 A * 1/1937 Terjesen ..... 200/246
4,339,734 A * 7/1982 Minks ..... 335/78
4,346,359 A * 8/1982 Pirner et al. ..... 335/202
4,370,636 A * 1/1983 VanPatten ..... 335/132
4,825,179 A * 4/1989 Nagamoto et al. ..... 335/80
5,144,270 A * 9/1992 Schedele et al. ..... 335/80
5,204,647 A * 4/1993 Mitsuki et al. ..... 335/80
5,790,004 A * 8/1998 Matsuoka et al. ..... 335/78
5,805,040 A * 9/1998 Corcoran ..... 335/202
6,023,212 A * 2/2000 Mader ..... 335/202
6,034,582 A * 3/2000 Fausch ..... 335/78
6,606,018 B2 * 8/2003 Takano et al. ..... 335/78
6,856,219 B2 * 2/2005 Kawai ..... 335/78
6,879,229 B2 * 4/2005 Tanaka et al. ..... 335/128
6,933,815 B2 * 8/2005 Saruwatari et al. ..... 335/78
6,940,375 B2 * 9/2005 Sanada et al. ..... 335/86
6,958,671 B2 * 10/2005 Chen et al. ..... 335/80
7,205,870 B2 * 4/2007 Sanada et al. ..... 335/78
2002/0135446 A1 * 9/2002 Takano et al. ..... 335/128
2005/0190025 A1 * 9/2005 Yamamoto et al. ..... 335/128

* cited by examiner

*Primary Examiner*—Elvin G Enad
*Assistant Examiner*—Alexander Talpalatskiy
(74) *Attorney, Agent, or Firm*—Brinks Hofer Gilson & Lione

(57) ABSTRACT

An electromagnetic relay includes an electromagnetic unit operable so as to generate a magnetic field perpendicular to a bottom wall of a housing when excited such that an actuating plate pivots from a releasing position to a pushing position, where a magnetically-attractable end portion of the actuating plate is attracted by the electromagnetic unit and where an actuating end portion of the actuating plate moves toward a first conductive plate, thereby driving a pushing block to move a resilient end portion of the first conductive plate toward a second conductive plate. Hence, first and second contacts on the first conductive plate contact electrically and respectively third and fourth contacts on the second conductive plate.

6 Claims, 9 Drawing Sheets

ELECTROMAGNETIC RELAY

BACKGROUND OF THE INVENTION

1. Field of the Invention

The invention relates to an electromagnetic device, more particularly to an electromagnetic relay.

2. Description of the Related Art

FIGS. 1 and 2 illustrate a conventional electromagnetic relay 100 that includes: a base seat 11 having a bottom wall 110, an electromagnetic 12 mounted in the base seat 11 and having two ends opposite to each other in a direction (L) that is parallel to the bottom wall 110, and a set of coil strands wound around an iron core (not shown) about a center axis (X) of the iron core parallel to the direction (L); a magnetically attractable actuating plate 13 mounted movably in the base seat 11 and disposed adjacent to one of the ends of the electromagnetic 12; a resilient first conductive plate 15 mounted in the base seat 11 and disposed adjacent to the other one of the ends of the electromagnetic 12; a second conductive plate 14 mounted in the base seat 11 and distal from the electromagnetic 12; and a pushing plate 16 extending in the direction (L), and interconnecting the actuating plate 13 and the first conductive plate 15. When the electromagnetic 12 is excited, the electromagnetic 12 generates a magnetic field in the direction (L) such that the actuating plate 13 is attracted to move toward the electromagnetic 12 so as to drive the first conductive plate 15 together with the pushing plate 16 to move toward and contact the second conductive plate 14, thereby activating the electromagnetic relay 100, as shown in FIG. 3.

In such a configuration, since the coil strands are disposed about the axis (X) that is parallel to the bottom wall 110, the electromagnetic 12 has a relatively long length in the direction (L). In addition, since the actuating plate 13 and the first conductive plate 15 are disposed respectively adjacent to the opposite ends of the electromagnetic 12, the pushing plate 15 has a relatively long length in the direction (L). As a result, the conventional electromagnetic relay 100 has a relatively long length in the direction (L), thereby resulting in a relatively large circuit footprint when installed on an external circuit board.

SUMMARY OF THE INVENTION

Therefore, the object of the present invention is to provide an electromagnetic relay that can overcome the aforesaid drawbacks of the prior art.

According to the present invention, an electromagnetic relay comprises:

a housing having a base seat, and a cover body covering the base seat, the base seat including a bottom wall, and opposite mounting walls extending uprightly from the bottom wall, spaced apart from each other in a first direction and cooperating with the bottom wall so as to define a receiving groove thereamong;

a conductive plate unit mounted on the base seat and including a first conductive plate disposed adjacent to the mounting walls of the base seat and having a resilient first end portion, and first and second conductive contacts mounted on the first end portion, and a second conductive plate spaced apart from the first conductive plate in a second direction that is perpendicular to the first direction, distal from the mounting walls of the base seat, and having a resilient second end portion, and third and fourth conductive contacts mounted on the second end portion and corresponding respectively to the first and second conductive contacts of the first conductive plate, a distance between the first and third conductive contacts being shorter than that between the second and fourth conductive contacts; and a magnetic pushing device disposed in the housing and including an electromagnetic unit mounted in the receiving groove in the base seat, the electromagnetic unit being operable so as to generate a magnetic field in a third direction that is perpendicular to the first and second directions when excited, an actuating plate disposed pivotally in the receiving groove and having a magnetically attractable end portion disposed movably adjacent to a bottom side of the electromagnetic unit, and an actuating end portion opposite to the magnetically attractable end portion and disposed movably adjacent to the electromagnetic unit, the actuating plate being operable so as to pivot between a pushing position and a releasing position, and a pushing block interconnecting the actuating end portion of the actuating plate and the first end portion of the first conductive plate.

When the actuating plate is in the pushing position, the pushing block is driven by the actuating end portion of the actuating plate to move the first end portion of the first conductive plate toward the second end portion of the second conductive plate such that the first and third conductive contacts, firstly, contact electrically each other and, subsequently, that the second and fourth conductive contacts electrically contact each other.

When the actuating plate is in the releasing position, the first end portion of the first conductive plate moves away from the second end portion of the second conductive plate.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
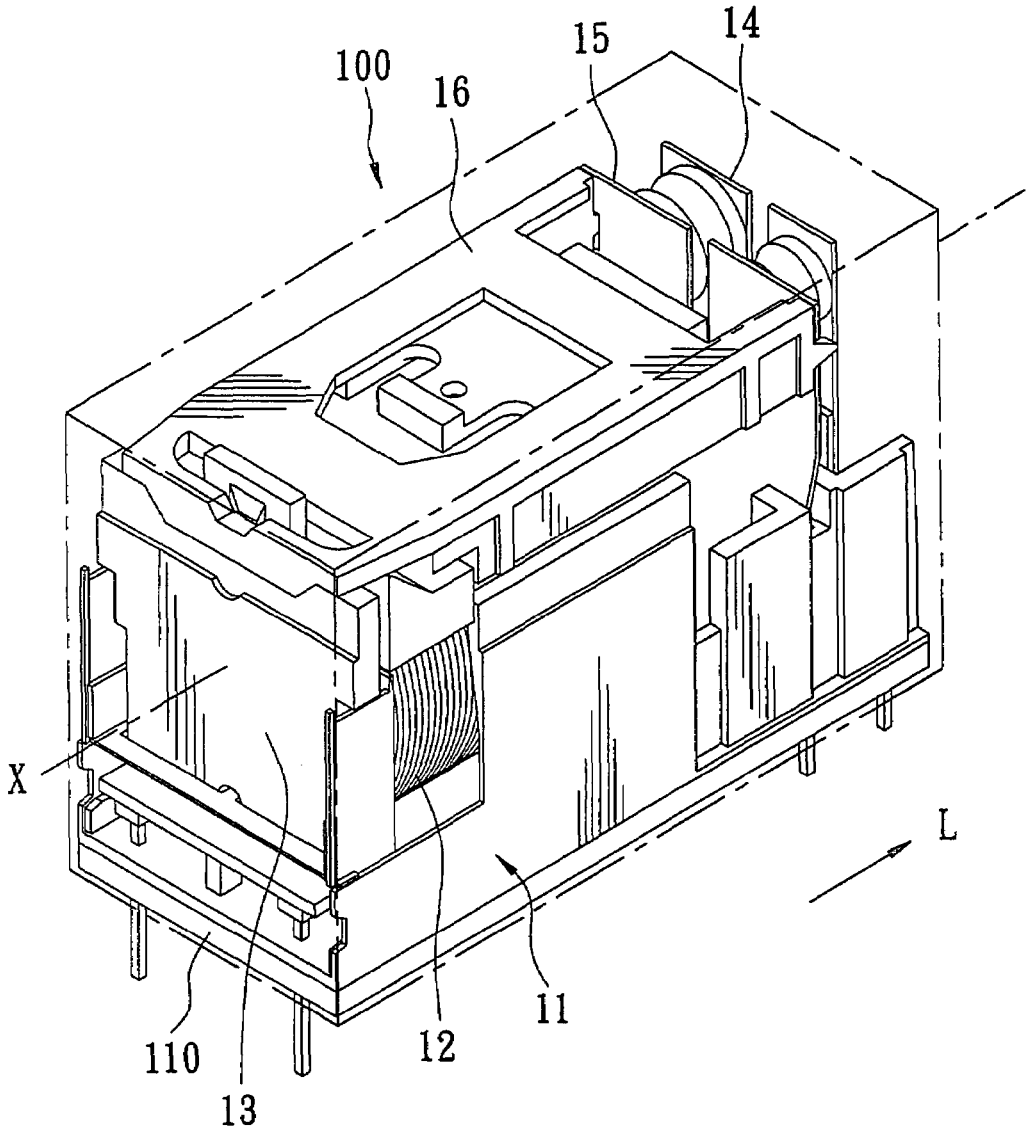
FIG. 1 PRIOR ART
FIG. 1 is a perspective view of a conventional electromagnetic relay.
Figure 2:
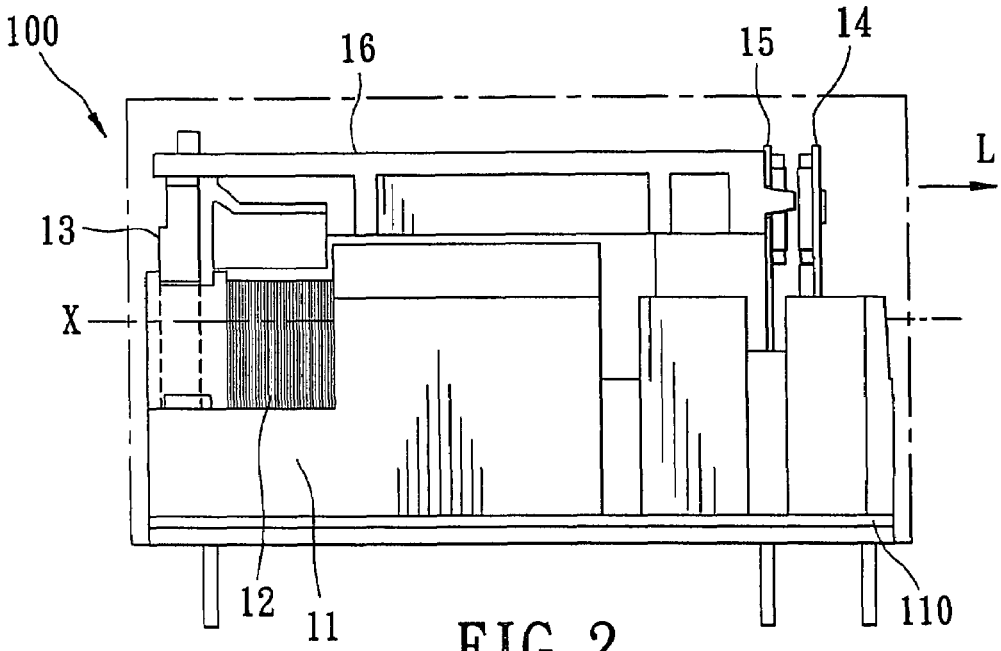
FIG. 2 PRIOR ART
FIG. 2 is a schematic view showing the conventional electromagnetic relay in a deactivated state.
Figure 3:
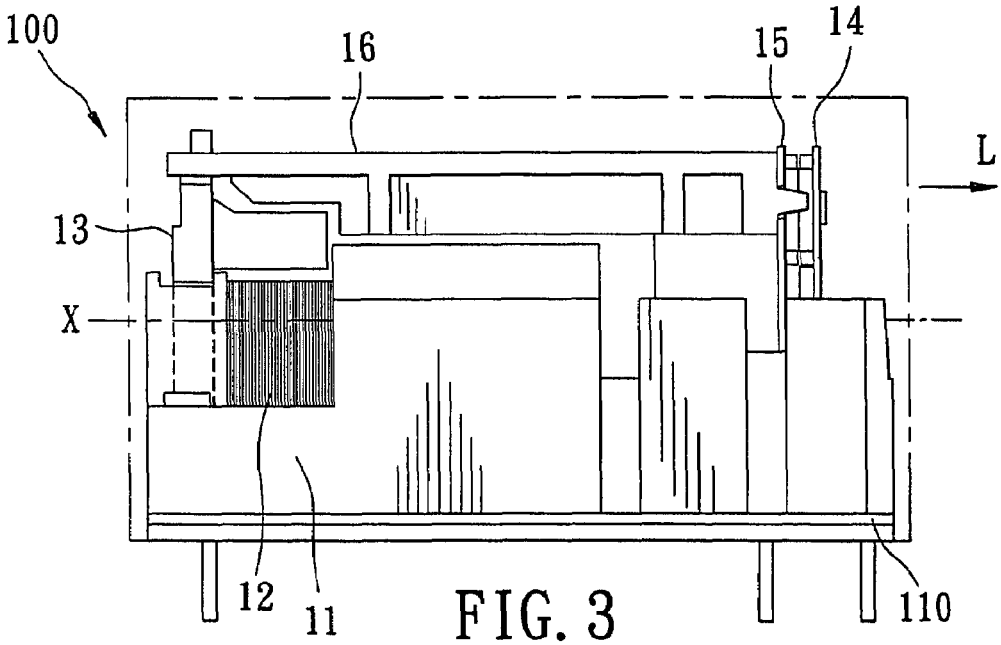
FIG. 3 PRIOR ART
FIG. 3 is a schematic view showing the conventional electromagnetic relay when operated in an activated state.
Figure 4:
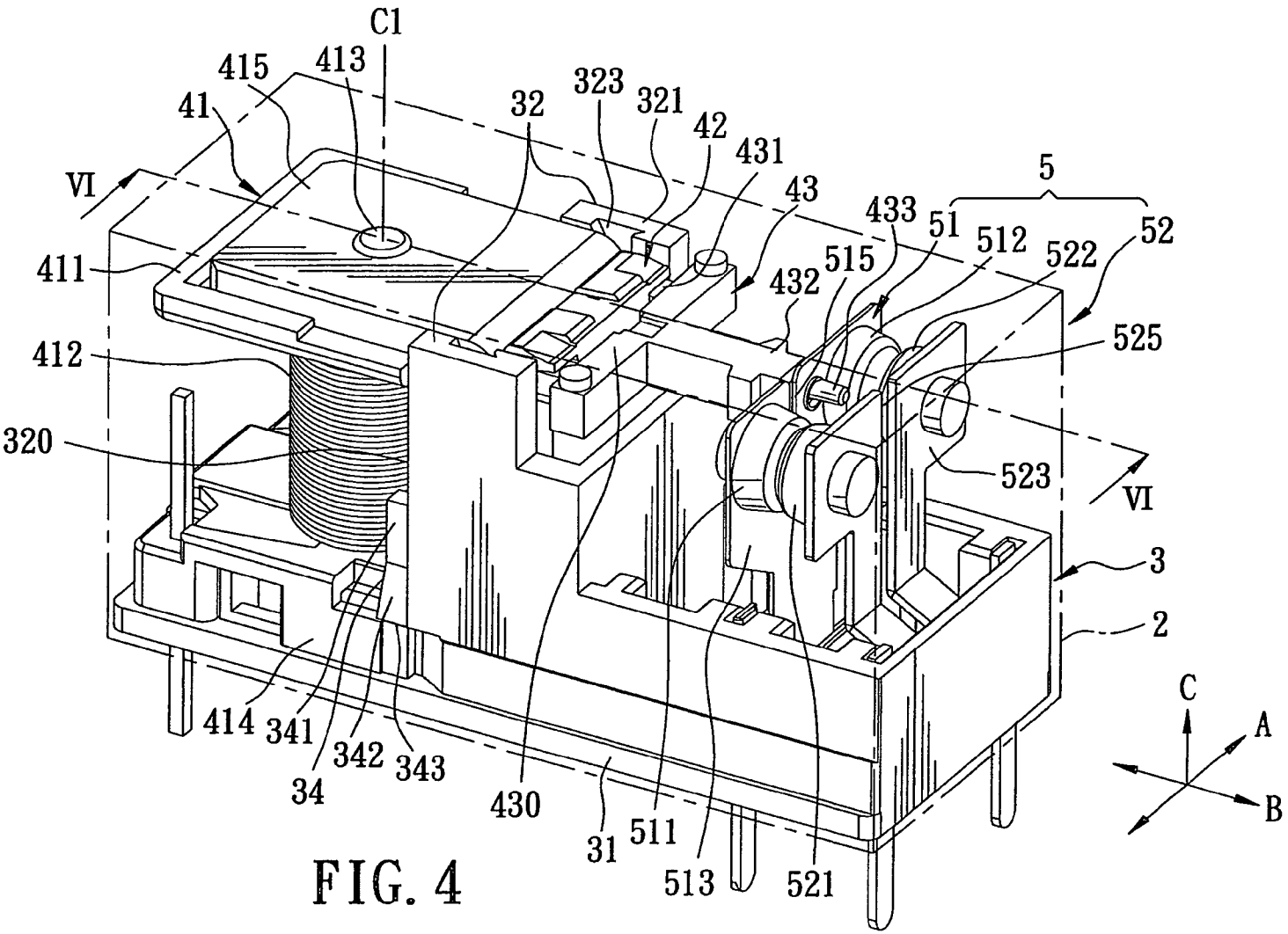
FIG. 4 is an assembled perspective view showing the preferred embodiment of an electromagnetic relay according to the present invention.
Figure 5:
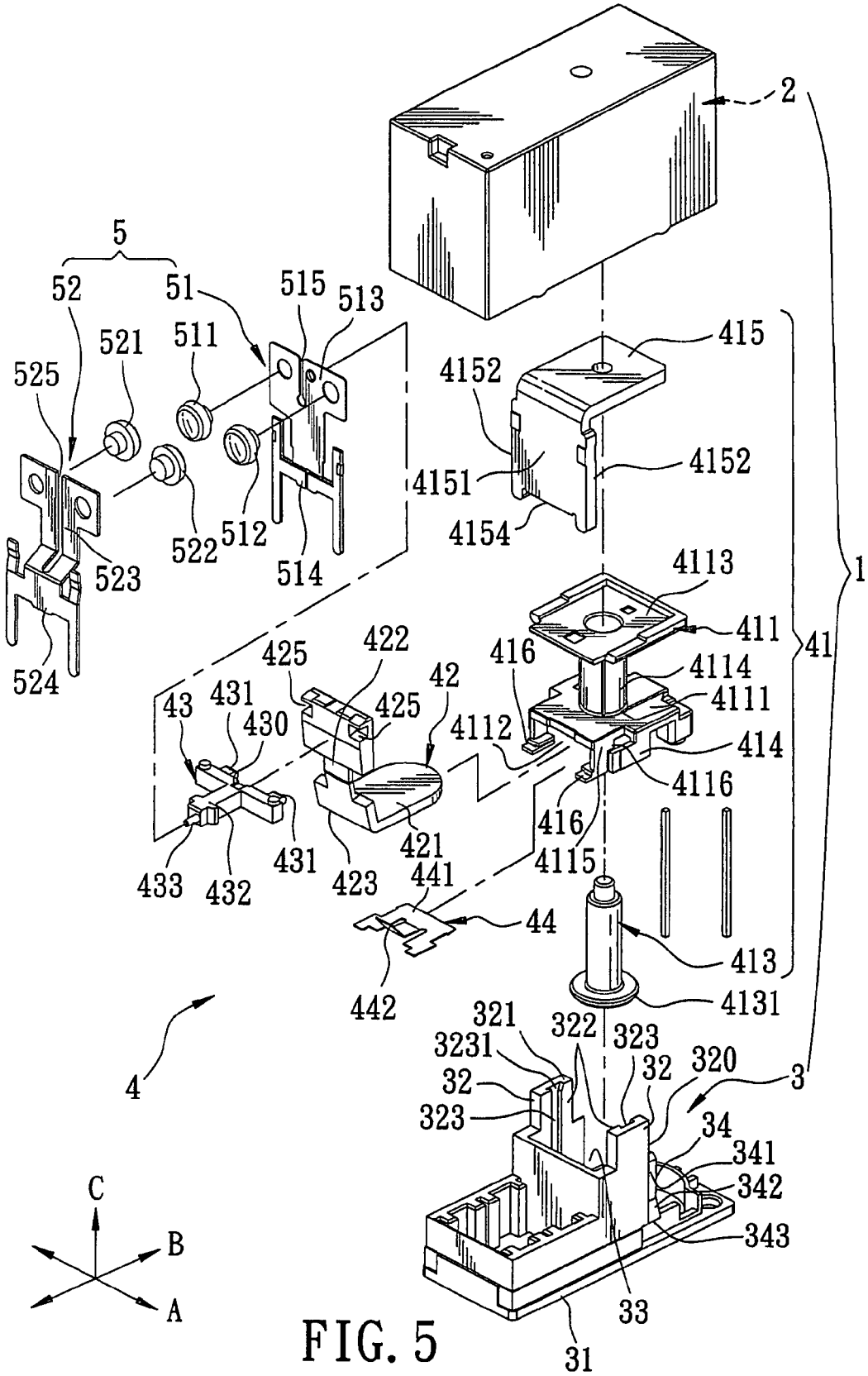
FIG. 5 is an exploded perspective view showing the preferred embodiment with a set of coil strands removed.
Figure 6:
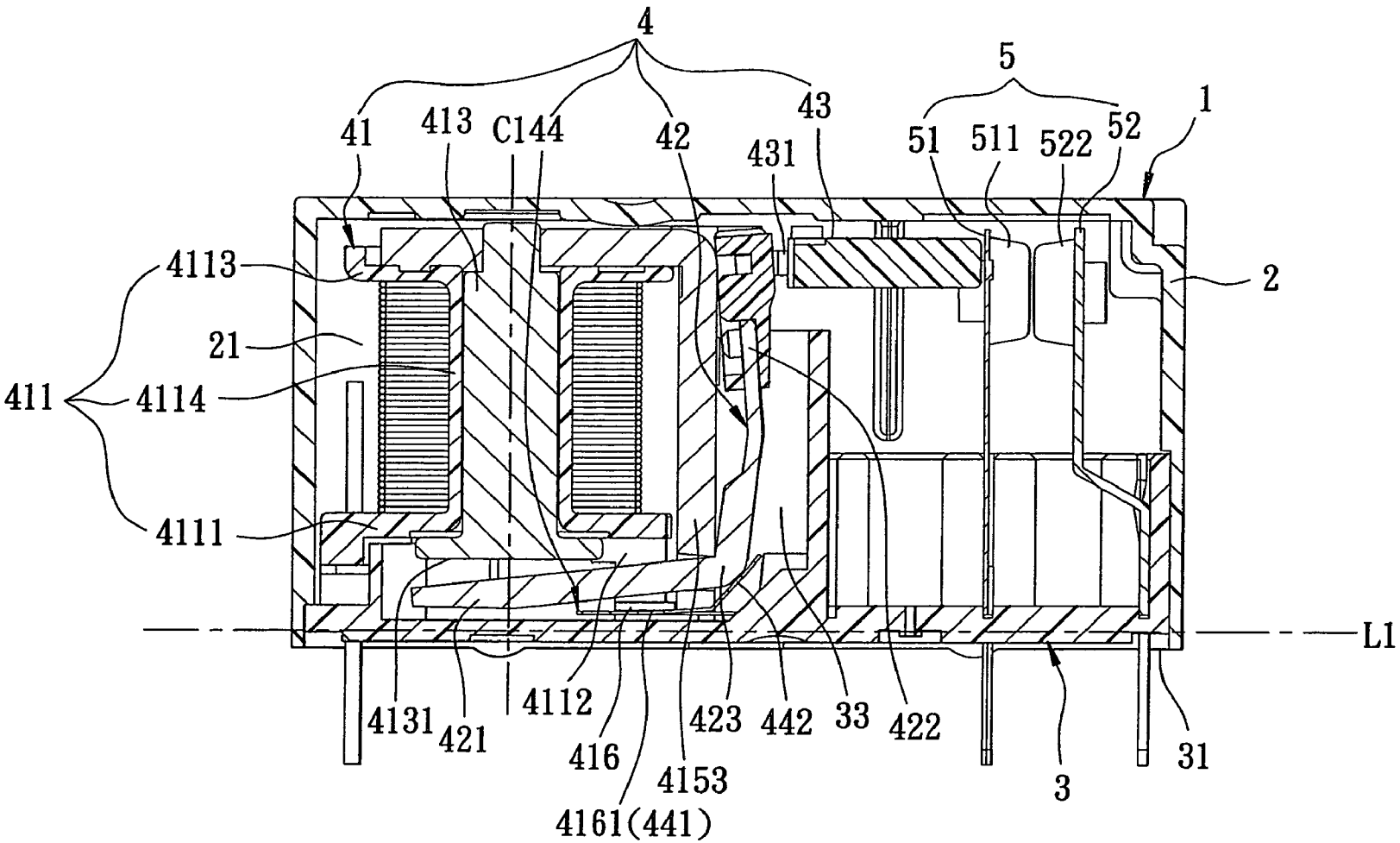
FIG. 6 is a schematic sectional view taken along line VI-VI in FIG. 4.

Referring to FIGS. 4 to 6, the preferred embodiment of an electromagnetic relay according to the present invention is shown to include a housing 1, a conductive plate unit 5, and a magnetic pushing device 4.

The housing 1 has a base seat 3, and a cover body 2 covering the base seat 3 and cooperating with the base seat 3 to define an inner accommodating space 21 (see FIG. 6) therebetween. The base seat 3 includes a bottom wall 31, and opposite mounting wall 32 extending uprightly from the bottom wall 31, spaced apart from each other in a first direction (A) and cooperating with the bottom wall 31 so as to define a receiving groove 33 (see FIG. 5) thereamong. In this embodiment, each mounting wall 32 has a top end 321, a lateral side 320, an inner surface 322 formed with a guiding groove 323 that extends downwardly from the top end 321, and an engaging block 34 formed integrally on the lateral side 320. The guiding groove 323 in each mounting wall 32 has an upwardly diverging end portion 3231 (see FIG. 5). The engaging block 34 of each mounting wall 32 has a vertical upper guiding face 341, a downwardly and outwardly inclined face 342 disposed immediately under the upper guiding face 341, and a horizontal bottom engaging face 343 disposed immediately under the inclined face 342, as shown in FIG. 5.

The conductive plate unit 5 is mounted on the base seat 3, is disposed distal from the lateral sides 320 of the mounting walls 32 of the base seat 3, and includes a first conductive plate 51 disposed adjacent to the mounting walls 32 of the base seat 3, and a second conductive plate 52, as shown in FIG. 4.

The first conductive plate 51 has a first terminal end portion 514 mounted fixedly on the bottom wall 31 of the base seat 3, a resilient first end portion 513, and first and second conductive contacts 511, 512 mounted fixedly on the first end portion 513, as shown in FIG. 5. In this embodiment, the first conductive plate 51 is formed with a first vertical slit 515 to divide the first end portion 513 into two sections mounted respectively with the first and second conductive contacts 511, 512.

Figure 9:
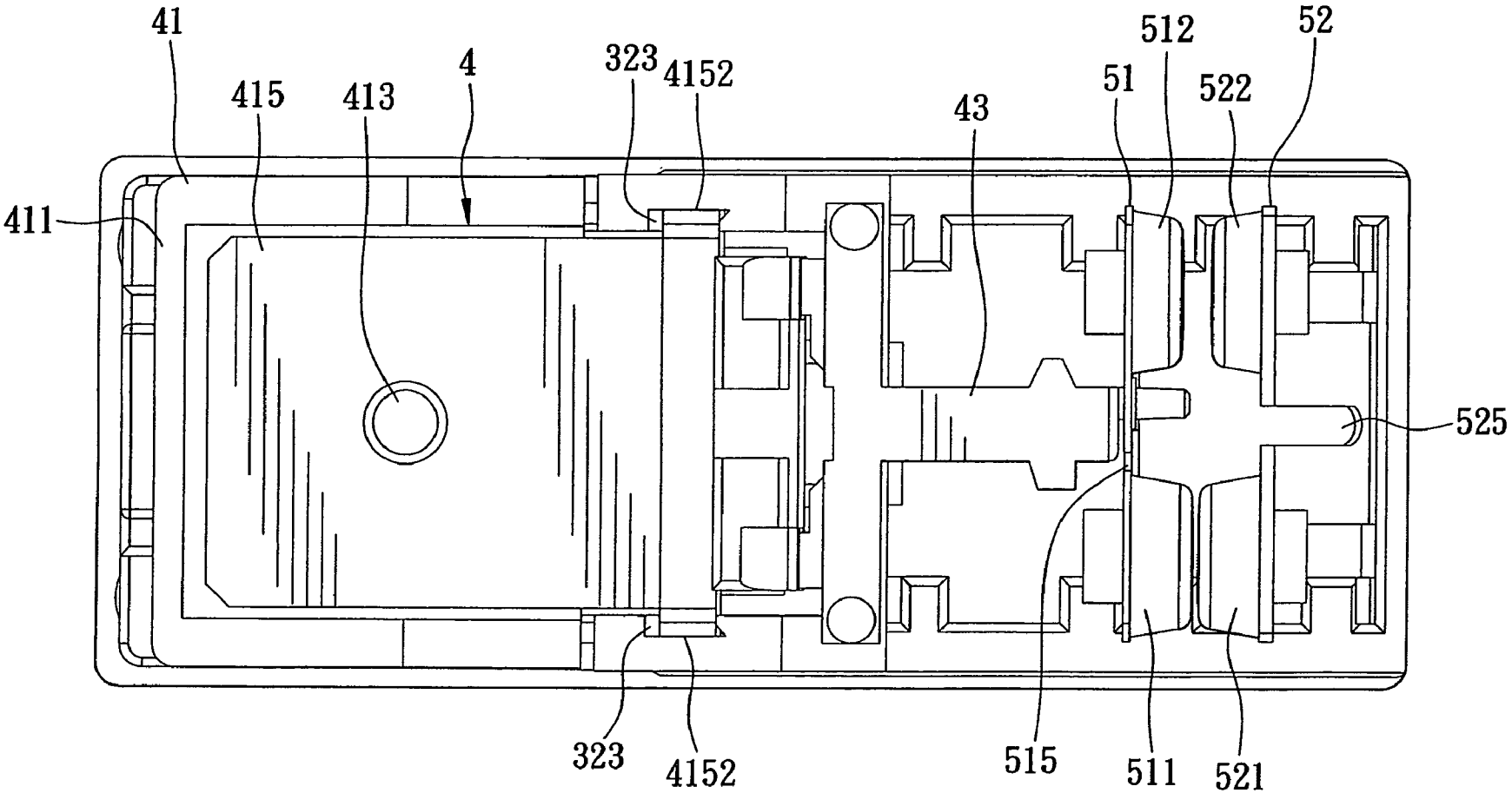
FIG. 9 is a schematic top view showing the preferred embodiment in a deactivated state.

The second conductive plate 52 is spaced apart from the first conductive plate 51 in a second direction (B) that is perpendicular to the first direction (A), and is distal from the mounting walls 32 of the base seat 3, as shown in FIG. 4. The second conductive plate 52 has a second terminal end portion 524 mounted fixedly on the bottom wall 31 of the base seat 3, a resilient second end portion 523, and third and fourth conductive contacts 521, 522 mounted fixedly on the second end portion 523 and corresponding respectively to the first and second conductive contacts 511, 512 of the first conductive plate 51, as shown in FIG. 5. In this embodiment, the second conductive plate 52 is formed with a second vertical slit 525 to divide the second conductive-mounting end portion 523 into two sections mounted respectively with the third and fourth conductive contacts 521, 522. The first vertical slit 515 having a length shorter than that of the second vertical slit 525. A distance between the first and third conductive contacts 511, 521 is shorter than that between the second and fourth conductive contacts 512, 522, as best shown in FIG. 9. In this embodiment, the first and third conductive contacts 511, 521 are made of ferro-tungsten alloy having a higher melting point and a larger impedance, and the second and fourth conductive contacts 512, 522 are made of silver alloy.

The magnetic pushing device 4 is disposed in the inner accommodating space 21, and includes an electromagnetic unit 41, a generally L-shaped actuating plate 42, a pushing block 43, and a biasing piece 44.

Figure 7:
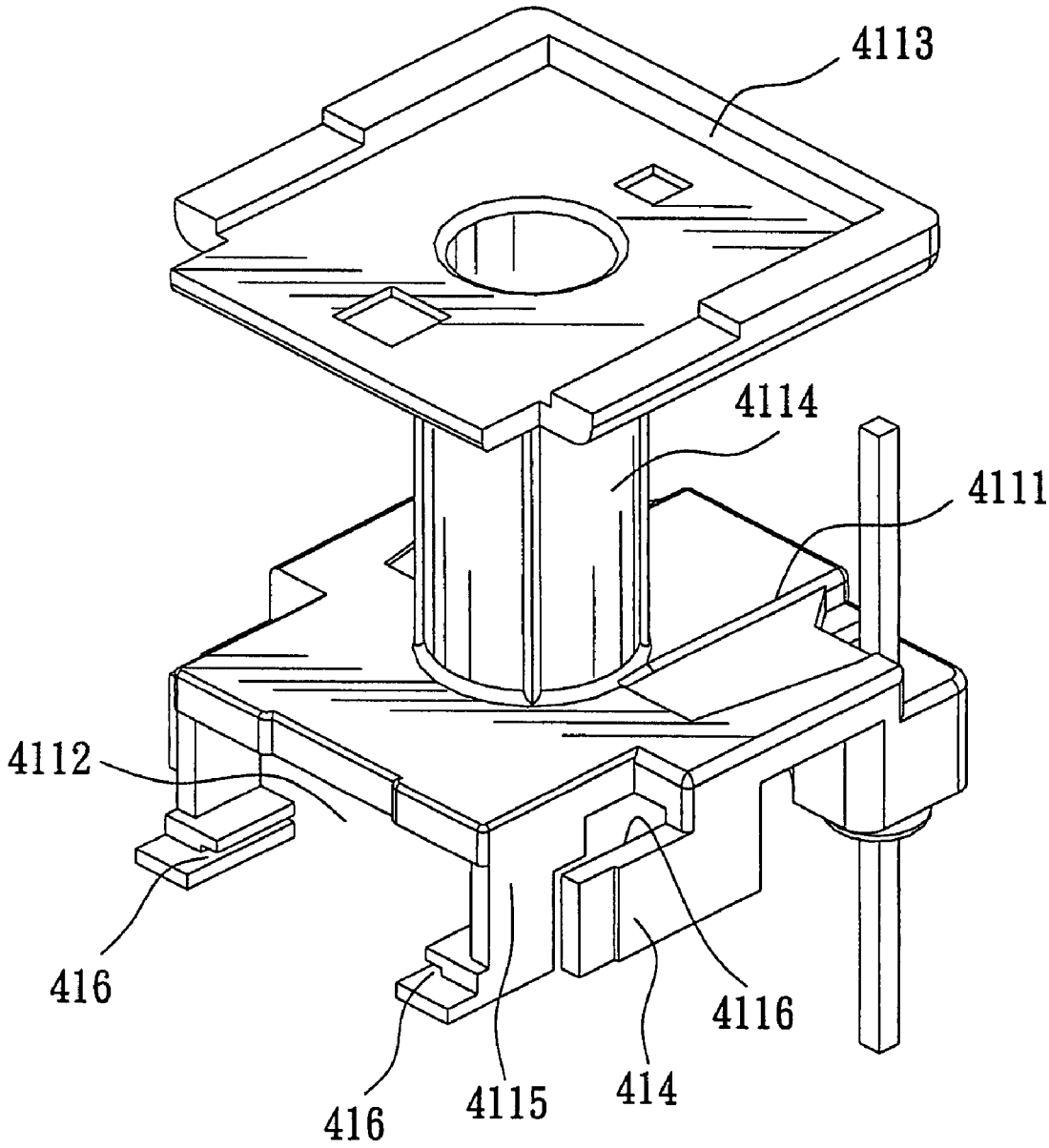
FIG. 7 is a perspective view showing an electromagnetic-mounting seat of the preferred embodiment.

The electromagnetic unit 41 is mounted in the receiving groove 33 in the base seat 3. The electromagnetic unit 41 is operable so as to generate a magnetic field in a third direction (C) that is perpendicular to the first and second directions (A, B), i.e., perpendicular to the bottom wall 31 of the base seat 3, when excited. In this embodiment, the electromagnetic unit 41 includes an electromagnetic-mounting seat 411, an iron core 413, a set of coil strands 412, and a metal anchoring plate 415. Referring further to FIG. 7, the electromagnetic-mounting seat 411 has a lower plate portion 4111 defined with an inserting groove 4112, an upper plate portion 4113, and an intermediate tube portion 4114 interconnecting the upper plate portion 4113 and the lower plate portion 4111. The lower plate portion 4111 has two lateral sidewalls 4115 opposite to each other in the first direction (A), and two resilient engaging arms 414 extending outwardly and respectively from the lateral sidewalls 4115. Each of the resilient engaging arms 414 cooperates with a corresponding one of the lateral sidewalls 4115 to define a vertical guide slot 4116 therebetween.

The iron core 413 is disposed in the intermediate tube portion 4114 of the electromagnetic-mounting seat 411. In this embodiment, the iron core 413 has an enlarged bottom end 4131 that extends outwardly of the intermediate tube portion 4114 into the inserting groove 4112 in the lower plate portion 4111, as shown in FIG. 6.

The coil strands 412 are wound around the intermediate tube portion 4114 about a center axis (C1) of the intermediate tube portion 4114 of the electromagnetic-mounting seat 411 that is parallel to the third direction (C), as shown in FIG. 6.

The metal anchoring plate 415 is connected fixedly to the electromagnetic-mounting seat 411. In this embodiment, the metal anchoring plate 415 is an L-shaped plate having a horizontal plate portion 4153 that is connected fixedly to the upper plate portion 4113 of the electromagnetic-mounting seat 411, and a vertical plate portion 4151 that has opposite vertical sides 4152 guided respectively by the upwardly diverging end portions 3231 of the guiding grooves 323 to engage respectively the guiding grooves 323 in the inner surfaces 322 of the mounting walls 32 when the electromagnetic unit 41 is assembled to the base seat 3, and a bottom end 4154.

The actuating plate 42 is disposed pivotally in the receiving groove 33 in the base seat 3, and has a magnetically attractable end portion 421 inserted into the inserting groove 4112 in the lower plate portion 4111 of the electromagnetic-mounting seat 411 and disposed adjacent to the bottom end 4131 of the iron core 413 of the electromagnetic unit 41, an actuating end portion 422 opposite to the magnetically attractable end portion 421 and disposed movably adjacent to the vertical plate portion 4151 of the metal anchoring plate 415 of the electromagnetic unit 41, and an intermediate fulcrum portion 423 interconnecting the magnetically attractable end portion 421 and the actuating end portion 422 and abutting against the bottom end 4154 of the vertical plate portion 4151 of the metal anchoring plate 415, as shown in FIG. 5, such that the magnetically attractable end portion 421 and the actuating end portion 422 are pivotable about the intermediate fulcrum portion 423. The actuating plate 42 is operable so as to pivot between a pushing position, where the magnetically attractable end portion 421 is attracted to abut against the bottom end 4131 of the iron core 413 as a result of the magnetic field generated by the electromagnetic unit 41 when excited and where the actuating end portion 422 moves toward the first conductive plate 51, and a releasing position, as shown in FIG. 6, where the magnetically attractable end portion 421 is spaced apart from the bottom end 4131 of the iron core 431 when the electromagnetic unit 41 is not excited and where the actuating end portion 422 moves away from the first conductive plate 51. In this embodiment, the actuating end portion 422 is formed with two engaging holes 425 opposite to each other in the first direction (A).

The pushing block 43 interconnects the actuating end portion 422 of the actuating plate 42 and the first end portion 513 of the first conductive plate 51. In this embodiment, the pushing block 43 has a first end portion 430 formed with two protrusions 431 engaging respectively the engaging holes 425 in the actuating end portion 422 of the actuating plate 42, and a second end portion 432 opposite to the first end portion 430 in the second direction (B), abutting against the first end portion 513 of the first conductive plate 51 and having an engaging rod 433 extending through the first end portion 513 of the first conductive plate 51, as shown in FIG. 4.

Figure 8:
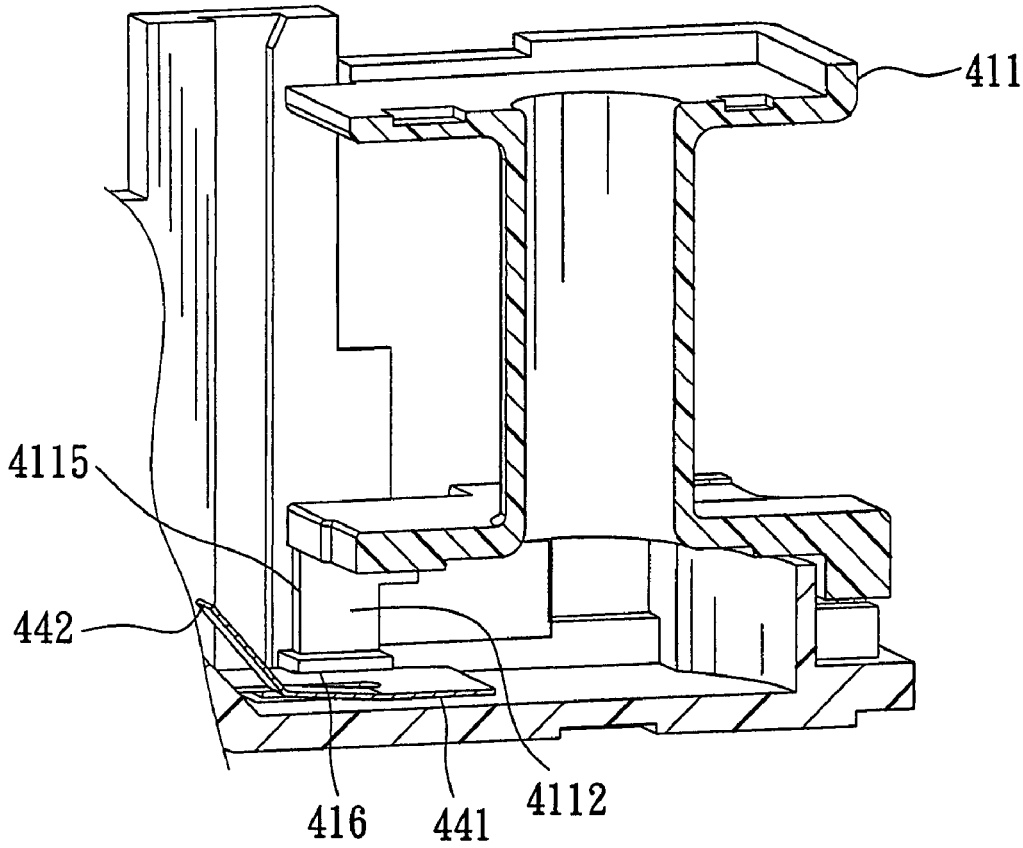
FIG. 8 is a fragmentary, cutaway, perspective view illustrating how a biasing piece of the preferred embodiment is mounted to the electromagnetic-mounting seat.

The biasing piece 44 biases the actuating plate 42 to the releasing position. In this embodiment, as shown in FIGS. 6 and 8, the biasing piece 44 has a base plate 441 having opposite sides that engage respectively inserting grooves 416 in the sidewalls 4115 of the lower plate portion 4111 of the electromagnetic-mounting seat 411, and a resilient upwardly extending biasing plate 442 connected integrally to the base plate 42 and abutting against the intermediate fulcrum portion 423 of the actuating plate 42.

During assembly, when an assembly of the electromagnetic unit 41, the actuating plate 42 and the biasing piece 44 is moved downwardly into the receiving groove 33 in the base seat 3, the guide slots 4116 in the lower plate portion 4111 of the electromagnetic-mounting seat 411 engage respectively the engaging blocks 34 of the mounting walls 32 of the base seat 3 such that the engaging arms 414 of the lower plate portion 4111 of the electromagnetic-mounting seat 411 slide downwardly and respectively on and are guided respectively by the upper guiding faces 341 and the inclined faces 342 of the engaging blocks 34 of the mounting walls 34 to two positions located immediately and respectively under the bottom engaging faces 343 of the engaging blocks 34 so as to prevent movement of the assembly of the electromagnetic unit 41, the actuating plate 42 and the biasing piece 44 relative to the mounting walls 32.

Figure 10:
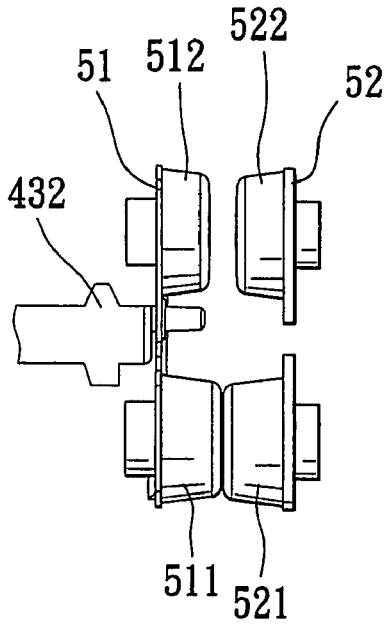
FIGS. 10 and 11 are fragmentary schematic top views showing the preferred embodiment when operated in an activated state.
Figure 11:
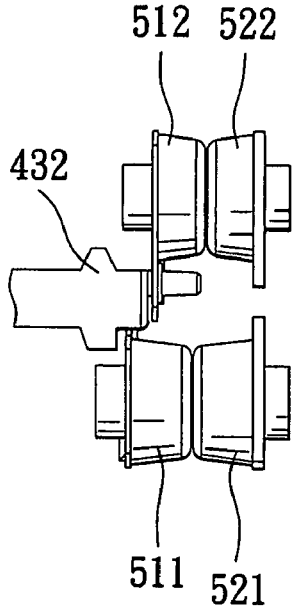

In such a configuration, when the actuating plate 42 is in the pushing position, the pushing block 43 is driven by the actuating end portion 422 of the actuating plate 42 to move the first end portion 513 of the first conductive plate 51 toward the second end portion 523 of the second conductive plate 52 such that the first and third conductive contacts 511, 521, firstly, contact electrically each other (see FIG. 10) and, subsequently, that the second and fourth conductive contacts 512, 522 electrically contact each other (see FIG. 11). It is noted that, due to the high melting point property of the first and third conductive contacts 511, 521, melting deformation in part or carbonization of the first and third conductive contacts 511, 521 resulting from arc generated instantaneously upon contacting the first conductive contact 511 with the third conductive contact 521 can be avoided. Due to the high impedance property of the first and third conductive contacts 511, 521, a surge current generated instantaneously upon contacting the first conductive contact 511 with the third conductive contact 521 can be eliminated. On the other hand, since the second and fourth conductive contacts 512, 522 are made of silver alloy, a good conductivity can be obtained.

When the actuating plate 542 is in the releasing position, the first end portion 513 of the first conductive plate 51 moves away from the second end portion 523 of the second conductive plate 52 due to a restoration force thereof such that the first and second conductive 511, 512 are spaced respectively apart from the third and fourth conductive contacts 521, 522.

In sum, since the coil strands of the electromagnetic unit 41 are disposed about the central axis (C1) that is perpendicular to the bottom wall 31 of the base seat 3, the electromagnetic unit 41 has a relatively small width in the second direction (B). Since the pushing block 43 and the first conductive plate 51 are disposed adjacent to the same side of the electromagnetic unit 41 in the second direction (B), the pushing block 43 has a relatively short length in the second direction (B). As a result, the electromagnetic relay of the present invention has a relatively short length in the second direction (B), thereby resulting in a relatively small circuit footprint when installed on an external circuit board.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An electromagnetic relay characterized by:

a housing having abase seat, and a cover body covering said base seat, said base seat including a bottom wall, and opposite mounting walls extending uprightly from said bottom wall, spaced apart from each other in a first direction and cooperating with said bottom wall so as to define a receiving groove thereamong;

a conductive plate unit mounted on said base seat and including a first conductive plate disposed adjacent to said mounting walls of said base seat and having a resilient first end portion, and first and second conductive contacts mounted on said first end portion, and a second conductive plate spaced apart from said first conductive plate in a second direction that is perpendicular to the first direction, distal from said mounting walls of said base seat, and having a resilient second end portion, and third and fourth conductive contacts mounted on said second end portion and corresponding respectively to said first and second conductive contacts of said first conductive plate, a distance between said first and third conductive contacts being shorter than that between said second and fourth conductive contacts; and a magnetic pushing device disposed in said housing and including an electromagnetic unit mounted in said receiving groove in said base seat, said electromagnetic unit being operable so as to generate a magnetic field in a third direction that is perpendicular to the first and second directions when excited, an actuating plate disposed pivotally in said receiving groove and having a magnetically attractable end portion disposed movably adjacent to a bottom side of said electromagnetic unit, and an actuating end portion opposite to said magnetically attractable end portion and disposed movably adjacent to said electromagnetic unit, said actuating plate being operable so as to pivot between a pushing position and a releasing position, and a pushing block interconnecting said actuating end portion of said actuating plate and said first end portion of said first conductive plate;

wherein, when said actuating plate is in the pushing position, said pushing block is driven by said actuating end portion of said actuating plate to move said first end portion of said first conductive plate toward said second end portion of said second conductive plate such that said first and third conductive contacts, firstly, contact electrically each other and, subsequently, that said second and fourth conductive contacts electrically contact each other; and wherein, when said actuating plate is in the releasing position, said first end portion of said first conductive plate moves away from said second end portion of said second conductive plate.

2. The electromagnetic relay as claimed in claim 1, wherein:

each of said mounting walls of said base seat has a top end, a lateral side distal from said conductive plate unit, an inner surface formed with a guiding groove that extends downwardly from said top end, and an engaging block formed integrally on said lateral side; and said electromagnetic unit includes an electromagnetic-mounting seat having a lower plate portion defined with an inserting groove for permitting insertion of said magnetically attractable end portion of said actuating plate thereinto, an upper plate portion, and an intermediate tube portion interconnecting said upper plate portion and said lower plate portion, said lower plate portion of said electromagnetic-mounting seat having two lateral sidewalls opposite to each other in the first direction, and two resilient engaging arms extending outwardly and respectively from said lateral sidewalls, each of said resilient engaging arms cooperating with a corresponding one of said lateral sidewalls to define a vertical guide slot therebetween, said guide slots engaging respectively said engaging blocks of said mounting walls of said base seat when said electromagnetic-mounting seat is assembled to said base seat, and a metal anchoring plate connected fixedly to said electromagnetic-mounting seat and having a vertical plate portion that is disposed between said actuating end portion of said actuating plate and said electromagnetic-mounting seat and that has opposite vertical sides engaging respectively said guiding grooves in said inner surfaces of said mounting walls, and a bottom end that abuts against said actuating plate.

3. The electromagnetic relay as claimed in claim 2, wherein said engaging block of each of said mounting walls has a vertical upper guiding face, a downwardly and outwardly inclined face disposed immediately under said upper guiding face, and a horizontal bottom engaging face disposed immediately under said inclined face such that, during assembly, when said electromagnetic unit is moved downwardly into said receiving groove in said base seat, said engaging arms of said lower plate portion of said electromagnetic-mounting seat slide downwardly and respectively on and are guided respectively by said upper guiding faces and said inclined faces of said engaging blocks of said mounting walls to two positions located immediately and respectively under said bottom engaging faces.

4. The electromagnetic relay as claimed in claim 2, wherein said magnetic pushing device further includes a biasing piece for biasing said actuating plate to the releasing position.

5. The electromagnetic relay as claimed in claim 1, wherein said first and third conductive contacts are made of ferro-tungsten alloy.

6. The electromagnetic relay as claimed in claim 1, wherein:

said first conductive plate is formed with a first vertical slit to divide said first end portion of said first conductive plate into two sections mounted respectively with said first and second conductive contacts; and said second conductive plate is formed with a second vertical slit to divide said second end portion of said second conductive plate into two sections mounted respectively with said third and fourth conductive contacts, said first vertical slit having a length shorter than that of said second vertical slit.

* * * * *